US010580293B2

(12) United States Patent
Jin et al.

(10) Patent No.: US 10,580,293 B2
(45) Date of Patent: Mar. 3, 2020

(54) TRAFFIC VOLUME DETERMINATION SYSTEM, TRAFFIC VOLUME DETERMINATION METHOD, AND NON-TRANSITORY COMPUTER-READABLE STORAGE MEDIUM STORING TRAFFIC VOLUME DETERMINATION PROGRAM

(71) Applicant: TOYOTA JIDOSHA KABUSHIKI KAISHA, Toyota-shi, Aichi-ken (JP)

(72) Inventors: Xin Jin, Nagoya (JP); Toshinori Takayama, Tokyo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 16/106,814

(22) Filed: Aug. 21, 2018

(65) Prior Publication Data

US 2019/0088118 A1 Mar. 21, 2019

(30) Foreign Application Priority Data

Sep. 15, 2017 (JP) ..... 2017-177568

(51) Int. Cl.
*G08G 1/01* (2006.01)

(52) U.S. Cl.
CPC ..... *G08G 1/0133* (2013.01)

(58) Field of Classification Search
CPC ..... G08G 1/0133
USPC ..... 340/933, 901, 902, 903, 904, 905, 928, 340/932, 937
See application file for complete search history.

(56) References Cited

U.S. PATENT DOCUMENTS 6,042,008 A * 3/2000 Ando ..... G07B 15/063 235/375
2002/0145541 A1* 10/2002 Matsui ..... G07B 15/063 340/934
2007/0032946 A1 2/2007 Goto et al.

FOREIGN PATENT DOCUMENTS

JP 2005-284588 A 10/2005
JP 2007-041294 A 2/2007
JP 2014-241090 A 12/2014

* cited by examiner

*Primary Examiner* — Daryl C Pope
(74) *Attorney, Agent, or Firm* — Hunton Andrews Kurth LLP

(57) ABSTRACT

A traffic volume determination system includes a table configured to store information indicating a statistical proportion of vehicles flowing into an exit link exiting from a node, among vehicles traveling on an entry link entering the node; an estimation unit configured to calculate an estimated value of a traffic volume of vehicles traveling on the exit link from an actual traffic volume of the vehicles traveling on the entry link, with reference to the table; and a determination unit configured to determine that the exit link is closed when the actual traffic volume of the vehicles traveling on the exit link is smaller than the estimated value.

6 Claims, 4 Drawing Sheets

TRAFFIC VOLUME DETERMINATION SYSTEM, TRAFFIC VOLUME DETERMINATION METHOD, AND NON-TRANSITORY COMPUTER-READABLE STORAGE MEDIUM STORING TRAFFIC VOLUME DETERMINATION PROGRAM

INCORPORATION BY REFERENCE

The disclosure of Japanese Patent Application No. 2017-177568 filed on Sep. 15, 2017 including the specification, drawings and abstract is incorporated herein by reference in its entirety.

BACKGROUND

1. Technical Field

The disclosure relates to a traffic volume determination system, a traffic volume determination method, and a non-transitory computer-readable storage medium storing a traffic volume determination program.

2. Description of Related Art

With the advancement of road-to-vehicle communication technology, collection of probe data by in-vehicle devices of vehicles traveling on roads has enabled the sequential accumulation of large amounts of traffic data with high precision. Accordingly, from time-series analyzation of the probe data for each road section, it is possible to analyze an average traffic volume and a moving history of a vehicle. In view of the above trends, Japanese Unexamined Patent Application Publication No. 2014-241090 (JP 2014-241090 A) discloses a technology for detecting a traffic restriction and a release of the restriction of a road based on probe data representing a traveling trajectory of a vehicle. Japanese Unexamined Patent Application Publication No. 2005-284588 (JP 2005-284588 A) discloses a technology for matching a traveling trajectory of a vehicle obtained from probe data to a link on a map database, counting the number of vehicles that pass through for each of the matched links for a plurality of the vehicles, and determining that a traffic restriction has been imposed on the link where the number of vehicles that pass through is lower than a threshold. Japanese Unexamined Patent Application Publication No. 2007-41294 (JP 2007-41294 A) discloses a technology for detecting a newly closed road from a difference between a distribution map of past traveling position data of a vehicle, which has been created using probe data with different collection periods, and a distribution map of future traveling position data of the vehicle.

SUMMARY OF THE DISCLOSURE

However, it is difficult to properly determine whether or not a given road is closed to vehicles in the technologies disclosed in JP 2014-241090 A, JP 2005-284588 A, and JP 2007-41294 A. This is because, in a case where a situation in which no vehicle travels on the given road occurs routinely at a specific time slot, determination cannot be made that the given road is closed just by the fact that the traffic volume at the specific time slot is zero. Whether or not a situation in which no vehicle travels can occur routinely on a given road at the specific time slot may vary from road to road and from day to day, even on the same road. The traffic volume of the given road is also affected by a presence or absence of an event at an area around the given road. It is desirable to determine whether or not the given road is closed to vehicles in consideration of the above described circumstances.

The disclosure provides a traffic volume determination system, a traffic volume determination method, and a non-transitory computer-readable storage medium storing a traffic volume determination program, which are capable of properly determining whether or not a link on a map database (hereinafter referred to as "link") is closed to vehicles.

A first aspect of the disclosure relates to a traffic volume determination system including a storage device and a processor. The storage device is configured to store a table configured to store information indicating a statistical proportion of vehicles flowing into an exit link exiting from a node, among vehicles traveling on an entry link entering the node. The processor is configured to calculate an estimated value of a traffic volume of vehicles traveling on the exit link from an actual traffic volume of the vehicles traveling on the entry link, with reference to the table. The processor is configured to determine that the exit link is closed when the actual traffic volume of the vehicles traveling on the exit link is smaller than the estimated value.

In the traffic volume determination system according to the first aspect of the disclosure, the table may be configured to further store information indicating a statistical proportion of vehicles having no history of traveling on the entry link among the vehicles traveling on the exit link.

A second aspect of the disclosure relates to a traffic volume determination system including a storage device and a processor. The storage device is configured to store a table configured to sort out and store information indicating a statistical proportion of vehicles flowing into an exit link exiting from a node, among vehicles traveling on a plurality of entry links entering the node, for each entry link. The processor is configured to calculate an estimated value of a traffic volume of vehicles traveling on the exit link from an actual traffic volume of the vehicles traveling on each of the entry links, with reference to the table. The processor is configured to determine that the exit link is closed when the actual traffic volume of the vehicles traveling on the exit link is smaller than the estimated value.

In the traffic volume determination system according to the second aspect of the disclosure, the table may be configured to further store information indicating a statistical proportion of vehicles having no history of traveling on the entry link among the vehicles traveling on the exit link.

A third aspect of the disclosure relates to a traffic volume determination method. The traffic volume determination method includes: preparing a table configured to store information indicating a statistical proportion of vehicles flowing into an exit link exiting from a node, among vehicles traveling on an entry link entering the node, by a computer system; calculating an estimated value of a traffic volume of vehicles traveling on the exit link from an actual traffic volume of the vehicles traveling on the entry link, with reference to the table, by the computer system; and determining that the exit link is closed when the actual traffic volume of the vehicles traveling on the exit link is smaller than the estimated value, by the computer system.

A fourth aspect of the disclosure relates to a non-transitory computer-readable storage medium storing a traffic volume determination program. The traffic volume determination program causes a computer system to execute steps of: preparing a table configured to store information indicating a statistical proportion of vehicles flowing into an exit link exiting from a node, among vehicles traveling on an entry link entering the node; calculating an estimated value of a traffic volume of vehicles traveling on the exit link from an actual traffic volume of the vehicles traveling on the entry link, with reference to the table; and determining that the exit link is closed when the actual traffic volume of the vehicles traveling on the exit link is smaller than the estimated value.

With the traffic volume determination system according to the aspects of the disclosure, it is possible to properly determine whether or not a link is closed to vehicles.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
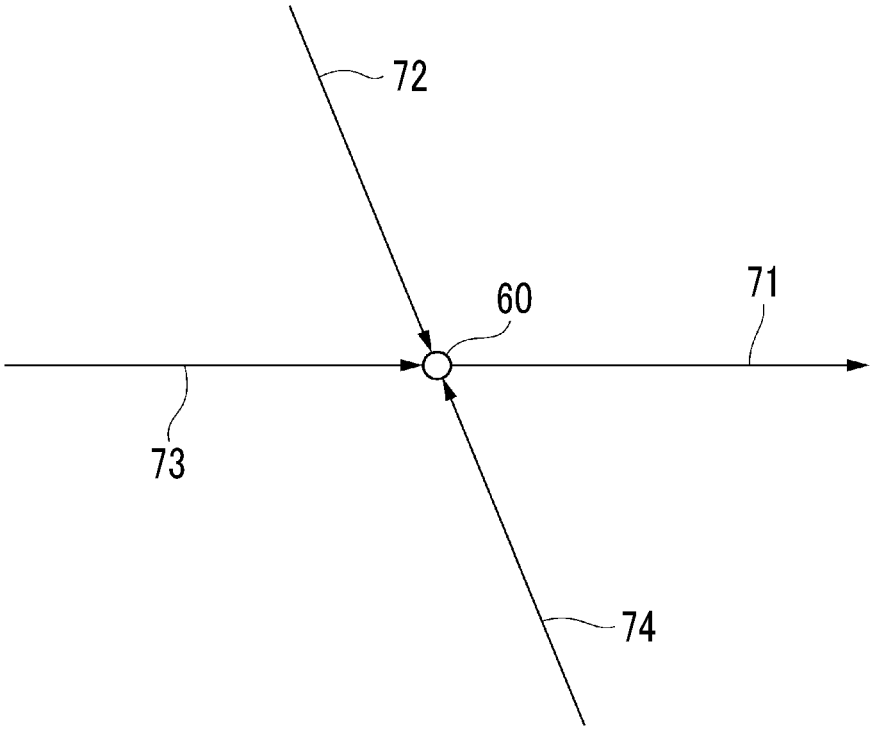
FIG. 1 is a graph showing a connection relationship between a node and a plurality of links according to an embodiment of the disclosure.

Hereinafter, an embodiment of the disclosure will be described with reference to the drawings. In the following description, the same reference numerals denote the same components, and redundant descriptions are omitted. In the embodiment, a network format is exemplified as a data format of nodes and links constituting road map information. The network type is a format in which a road section from a predetermined intersection to another intersection is taken as a graph link according to the graph theory and the intersection is taken as a node of the graph.

FIG. 1 is a graph showing a connection relationship between a node 60 and a plurality of links 71, 72, 73, 74. The link 71 is a vector starting from the node 60 and ending at another node (not shown). Since the link 71 is a link exiting from the node 60, the link 71 may be referred to as an exit link 71, for the purpose of distinguishing it from an entry link to be described later. Meanwhile, the links 72, 73, 74 are vectors ending at the node 60 and starting from another node (not shown). Since the links 72, 73, 74 are links entering the node 60, the links 72, 73, 74 may be referred to as entry links 72, 73, 74, respectively, for the purpose of distinguishing them from the above-mentioned exit link. For a road that is a two-way road, it is possible to define two links (exit link and entry link) of which traffic directions are opposite to each other on the same road section. In the embodiment, for convenience in considering the statistical proportion of the vehicles flowing into the exit link 71 through the node 60 among the vehicles traveling on each of the entry links 72, 73, 74, the illustration of a link having an advance direction opposite to the advance direction of each of the links 71, 72, 73, 74 is omitted.

Figure 2:
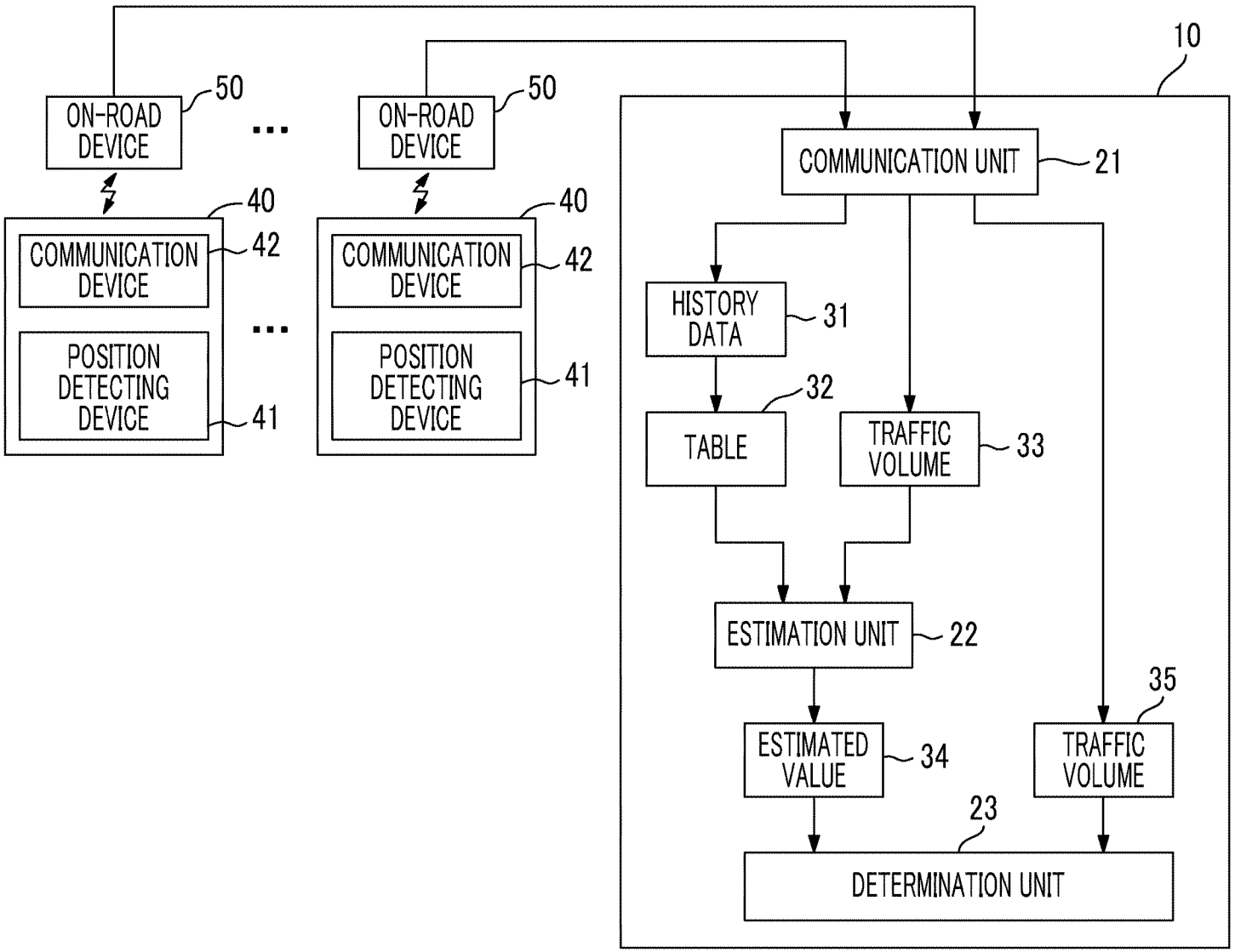
FIG. 2 is an explanatory diagram showing a functional block of a traffic volume determination system according to the embodiment of the disclosure.

FIG. 2 is an explanatory diagram showing a functional block of a traffic volume determination system 10 according to the embodiment of the disclosure. The traffic volume determination system 10 is a computer system that determines a traffic volume on the road (the number of vehicles 40 passing through per unit time) based on probe data acquired from a plurality of vehicles 40. Each of the vehicles 40 has a position detecting device 41 for detecting the position of the own vehicle and a communication device 42 for wirelessly transmitting the probe data to on-road devices 50. The probe data contains position information, speed information, and time information of each of the vehicles 40, and each of the vehicles 40 that wirelessly transmit the probe data described above is called a probe car. The position detecting device 41 is, for example, a global positioning system (GPS). The road-to-vehicle communication method between the communication device 42 and the on-road device 50 is, for example, an optical beacon, a wireless local area network (LAN), or a dedicated short range communication (DSRC).

A plurality of on-road devices 50 is disposed along the links 71, 72, 73, 74. The traffic volume determination system 10 collects the probe data received from the vehicles 40 by each of the on-road devices 50, and acquires the information about the traffic volume of the vehicles 40 traveling on the links 71, 72, 73, 74. Since the on-road devices 50 are not indispensable, the traffic volume determination system 10 may receive the probe data from the vehicles 40 through wireless communication (for example, a mobile phone line or a dedicated line).

The traffic volume determination system 10 includes a communication unit 21, an estimation unit 22, and a determination unit 23. The traffic volume determination system 10 includes a processor, a storage resource, and a communication interface as hardware resources. The storage resource is a storage area of a computer-readable recording medium (for example, a hard disk drive, a solid-state drive, a memory card, an optical disk drive, or a semiconductor memory). A traffic volume determination program that controls an operation of the traffic volume determination system 10 is stored, in the storage resource. The traffic volume determination program is a computer program causing the traffic volume determination system 10 to execute a process of steps 301 to 305 shown in FIG. 3. The functions of the communication unit 21, the estimation unit 22, and the determination unit 23 are realized in cooperation with the hardware resources of the traffic volume determination system 10 and the traffic volume determination program. The functions similar to those of the estimation unit 22 and the determination unit 23 may be realized by using a dedicated hardware resource (for example, an application specific integrated circuit (ASIC)) or a firmware.

The communication unit 21 receives the probe data wirelessly transmitted from the vehicles 40, and stores the received probe data as history data 31 in the storage resource. The history data 31 includes history information relating to the traffic volume of the vehicles 40 traveling on each of the links 71, 72, 73, 74 for a certain period of time from the past to the present.

With reference to the history data 31, the processor of the traffic volume determination system 10 prepares a table 32, in which information indicating the statistical proportion of the vehicles 40 flowing into the exit link 71 among the vehicles 40 traveling on the plurality of entry links 72, 73, 74 is sorted out and stored for each of the entry links 72, 73, 74, and saves the table in the storage resource. Among the vehicles 40 traveling on each of the entry links 72, 73, 74, the statistical proportion of the vehicles 40 flowing into the exit link 71 may vary from time slot to time slot on the same day of the week, and may also vary from day to day even in the same time slot. Therefore, for example, it is desirable that information indicating the statistical proportion of the vehicles 40 flowing into the exit link 71 among the vehicles 40 traveling on each of the entry links 72, 73, 74 is sorted out for each time slot and for each day of the week and stored in the table 32. For example, it is desirable to calculate the statistical proportion of the vehicles 40 flowing into the exit link 71 among the vehicles 40 traveling on each of the entry links 72, 73, 74 by excluding, in advance, exceptional fluctuations in the traffic volume which increase or decrease due to accidents or the like. In the processor of the traffic volume determination system 10, the information indicating the statistical proportion of the vehicles 40 having no history of traveling on the entry links 72, 73, 74 for a certain period of time (for example, the vehicles 40 that flow into the exit link 71 after having parked in a parking lot in near the exit link 71 for a certain period of time) among the vehicles 40 traveling on the exit link 71, may be sorted out for each time slot and for each day of the week, and be stored in the table 32.

The estimation unit 22 is configured to calculate an estimated value 34 of the traffic volume of the vehicles 40 traveling on the exit link 71 from an actual traffic volume 33 of the vehicles 40 traveling on each of the entry links 72, 73, 74, with reference to the table 32. The determination unit 23 is configured to determine that the exit link 71 is closed when an actual traffic volume 35 of the vehicles 40 traveling on the exit link 71 is smaller than the estimated value 34. In a case where the distribution of errors between the traffic volume 35 and the estimated value 34 follows a normal distribution, approximately 95.5% of the traffic volume 35 can be considered to be distributed within the range of twice the standard deviation. For this reason, more than a statistical error can be interpreted, for example, to mean being more than twice the standard deviation. However, the interpretation of the statistical error is not limited to the above example, and other statistically valid interpretations may be used.

Figure 3:
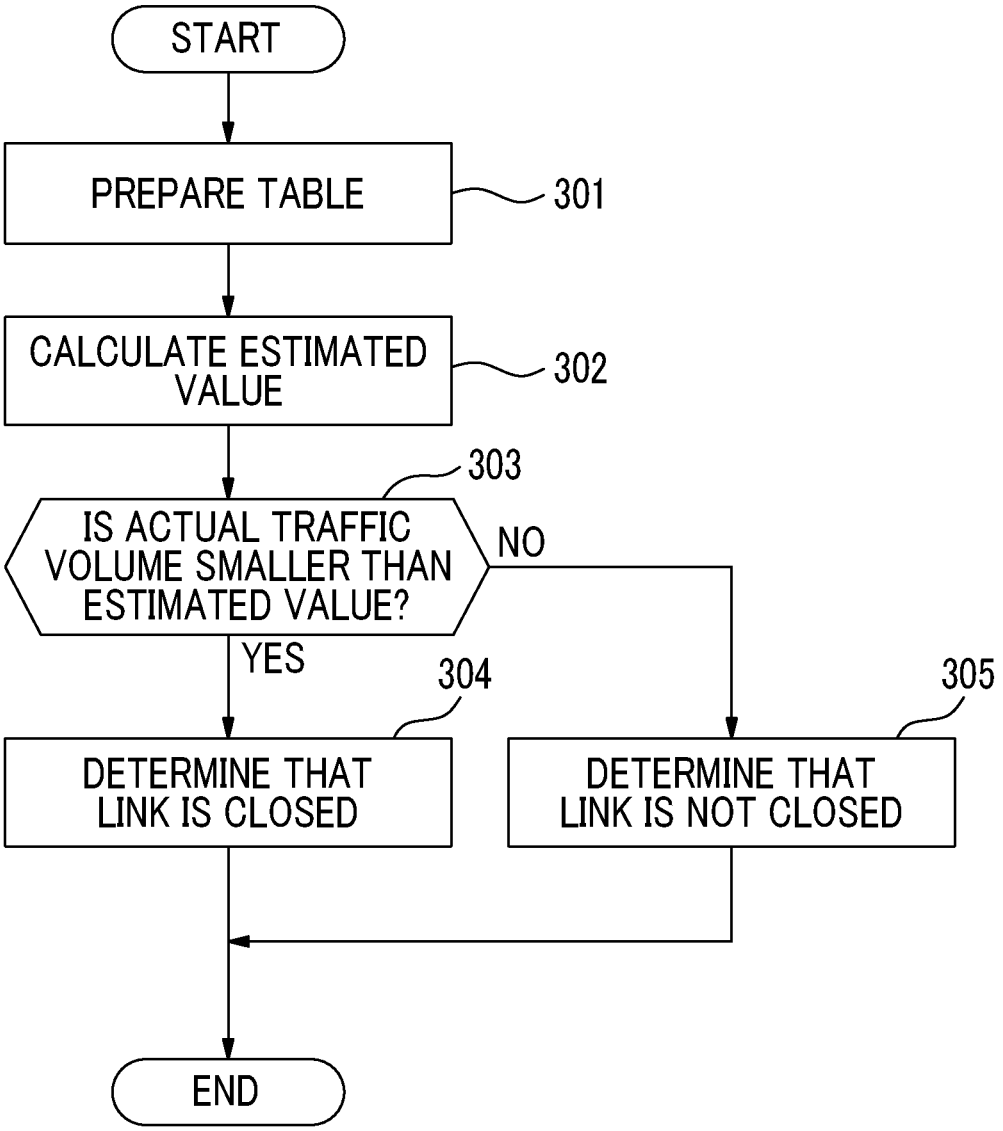
FIG. 3 is a flowchart showing a flow of a process of a traffic volume determination method according to the embodiment of the disclosure.

FIG. 3 is a flowchart showing a flow of a process of a traffic volume determination method according to the embodiment of the disclosure. Prior to processing of step 301, it is assumed that the history data 31 is stored in the storage resource of the traffic volume determination system 10. The processor of the traffic volume determination system 10 prepares the table 32 with reference to the history data 31 (step 301). From the actual traffic volume 33 of the vehicles 40 traveling on each of the entry links 72, 73, 74, the estimation unit 22 calculates the estimated value 34 of the traffic volume of the vehicles 40 traveling on the exit link 71 with reference to the table 32 (step 302). When the actual traffic volume 35 of the vehicles 40 traveling on the exit link 71 is smaller than the estimated value 34 (step 303: YES), the determination unit 23 determines that the exit link 71 is closed (step 304). On the other hand, when the traffic volume 35 is not smaller than the estimated value 34 (step 303: NO), the determination unit 23 determines that the exit link 71 is not closed (step 305).

Figure 4:
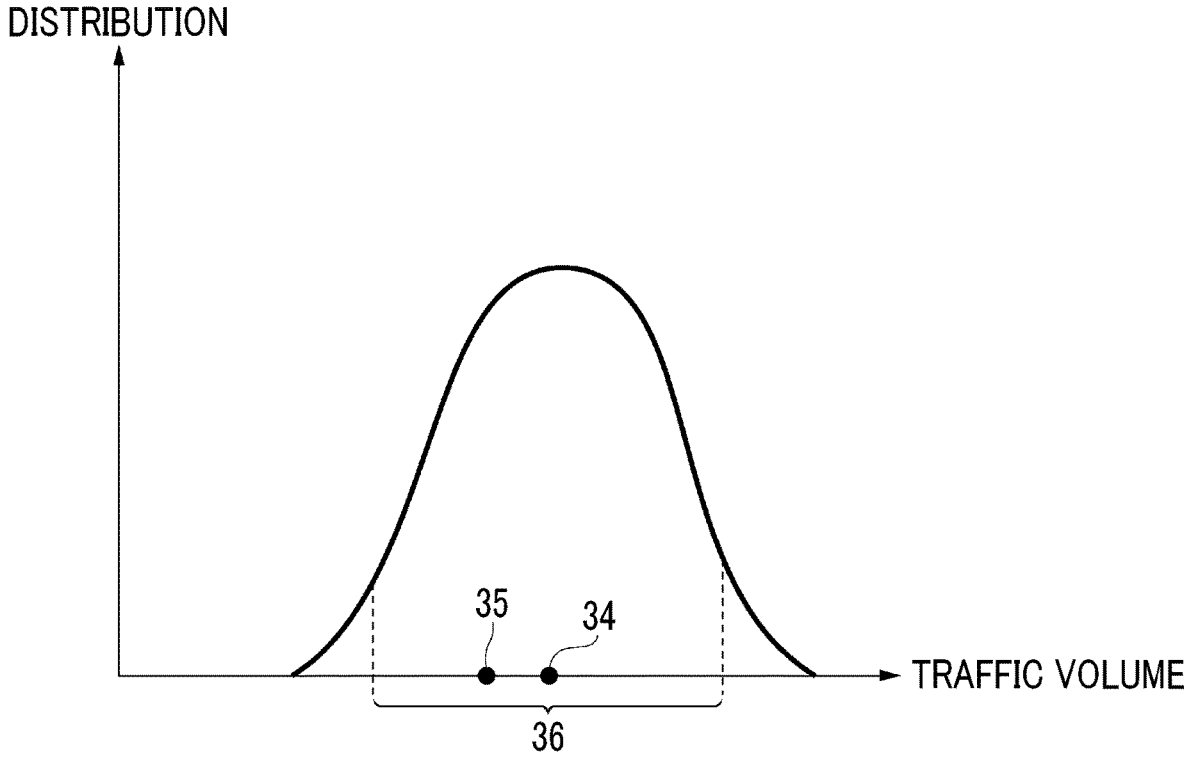
FIG. 4 is a graph showing a specific example of determining a closing of the link according to the embodiment of the disclosure.

Here, with reference to FIG. 1, a specific example of determining the closing of the exit link 71 will be described. For example, in a predetermined time slot on a predetermined day of the week, it is assumed that the statistical proportion of the vehicles 40 flowing into the exit link 71 among the vehicles 40 traveling on the entry link 72 is 20%, the statistical proportion of the vehicles 40 flowing into the exit link 71 among the vehicles 40 traveling on the entry link 73 is 50%, the statistical proportion of the vehicles 40 flowing into the exit link 71 among the vehicles 40 traveling on the entry link 74 is 25%, and the statistical proportion of the vehicles 40 having no history of traveling on the entry links 72, 73, 74 among the vehicles 40 traveling on the exit link 71 is 10%. It is assumed that the actual traffic volume 33 of the vehicles 40 traveling on the entry links 72, 73, 74 in the time slot of the day of the week is 6 vehicles, 14 vehicles, and 8 vehicles, respectively. In this case, the estimated value 34 of the traffic volume of the vehicles 40 traveling on the exit link 71 is 11.3 vehicles ((6 vehicles×0.2+14 vehicles×0.5+8 vehicles×0.25)÷0.9=11.3 vehicles). When it is assumed that the actual traffic volume 35 of the vehicles 40 traveling on the exit link 71 in the time slot of the day of the week is 10 vehicles, the error between the traffic volume 35 and the estimated value 34 is within the range of a statistical error 36, as shown in FIG. 4, determination is made that the exit link 71 is not closed.

Under the condition that the statistical proportion of the vehicles 40 flowing into the exit link 71 among the vehicles 40 traveling on the each of the entry links 72, 73, 74, and the statistical proportion of the vehicles 40 having no history of traveling on the entry links 72, 73, 74 among the vehicles 40 traveling on the exit link 71 are the same as in the above described example, it is conceivable that the actual traffic volume 33 of the vehicles 40 traveling on each of the entry links 72, 73, 74 decreases to one vehicle, and the actual traffic volume 35 of the vehicles 40 traveling on the exit link 71 also decreases to one vehicle. In this case, the estimated value 34 of the traffic volume of the vehicles 40 traveling on the exit link 71 is (1 vehicle×0.2+1 vehicle×0.5+1 vehicle×0.25)÷0.9=1.1 vehicles. As described above, even when it is assumed that the actual traffic volume 35 of the vehicles 40 traveling on the exit link 71 decreases, when the actual traffic volume 33 of the vehicles 40 traveling on each of the entry links 72, 73, 74 also decreases, the decrease of the traffic volume 35 as described above can be considered to be a natural traffic phenomenon. Since the error between the traffic volume 35 and the estimated value 34 is within the range of the statistical error 36, determination is made that the exit link 71 is not closed.

Figure 5:
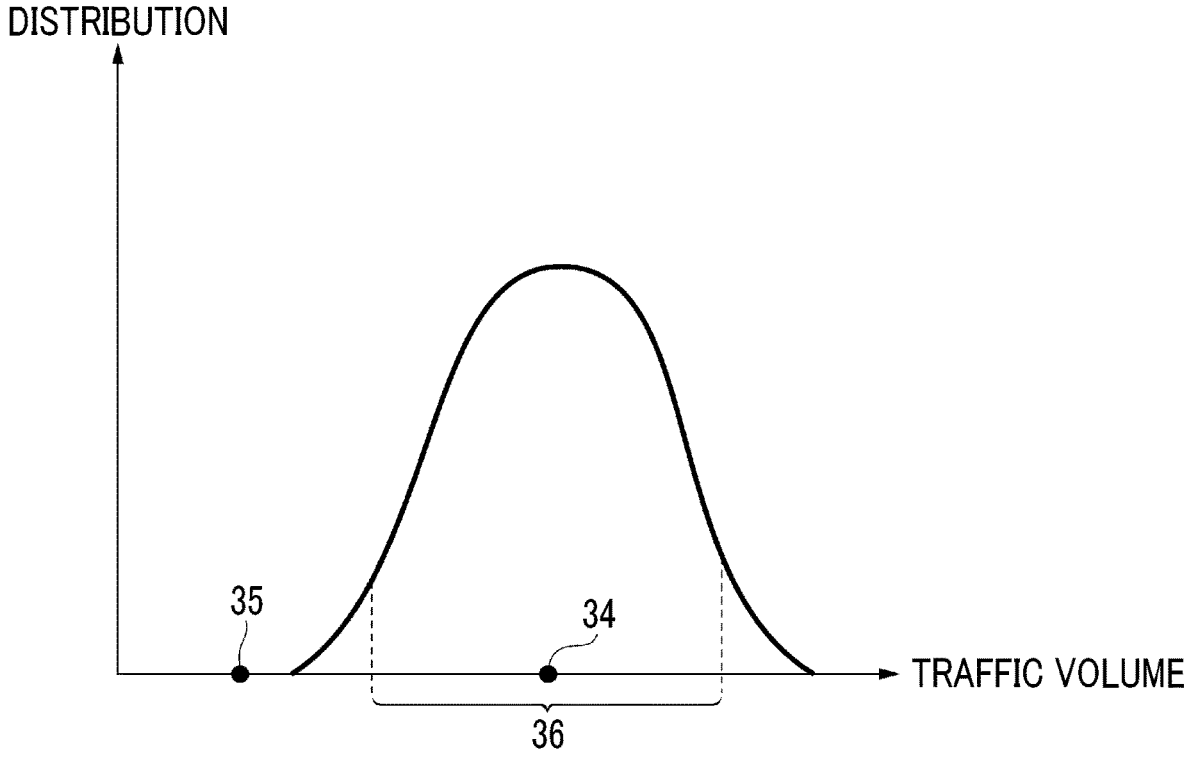
FIG. 5 is a graph showing another specific example of determining the closing of the link according to the embodiment of the disclosure.

Under the condition that the statistical proportion of the vehicles 40 flowing into the exit link 71 among the vehicles 40 traveling on each of the entry links 72, 73, 74, and the statistical proportion of the vehicles 40 having no history of traveling on the entry links 72, 73, 74 among the vehicles 40 traveling on the exit link 71 are the same as in the above described example, it is conceivable that the actual traffic volume 33 of the vehicles 40 traveling on each of the entry links 72, 73, 74 changes to 9 vehicles, 10 vehicles, and 12 vehicles, respectively, and the actual traffic volume 35 of the vehicles 40 traveling on the exit link 71 decreases to 0 vehicles. In this case, the estimated value 34 of the traffic volume of the vehicles 40 traveling on the exit link 71 is (9 vehicles×0.2+10 vehicles×0.5+12 vehicles×0.25)÷0.9=10.9 vehicles. As described above, even when the actual traffic volume 33 of the vehicles 40 traveling on each of the entry links 72, 73, 74 is not markedly decreased, when the actual traffic volume 35 of the vehicles 40 traveling on the exit link 71 is markedly decreased, the decrease of the traffic volume 35 as described above can be considered to be an unnatural traffic phenomenon. As shown in FIG. 5, since the traffic volume 35 is smaller than the estimated value 34 by more than the statistical error 36, determination is made that the exit link 71 is closed.

According to the embodiment, by using the statistical proportion of the vehicles 40 flowing into the exit link 71 among the traveling vehicles 40 traveling on each of the entry link 72, 73, 74, and calculating the estimated value 34 of the traffic volume of the vehicles 40 traveling on the exit link 71, from the actual traffic volume 33 of the traveling vehicles 40 traveling on each of the entry links 72, 73, 74, it is possible to further suppress an erroneous determination as to whether or not the exit link 71 is closed.

In the embodiment, when focusing on one exit link among a plurality of links connected to one node, it is to be noted that, among the remaining links except the one exit link, a link on which the vehicles may flow into the one exit link via the node is taken as the entry link. For example, in the example shown in FIG. 1, in a case where the exit link 71 is one of the two links which can be defined in the same road section of a two-way road and of which traffic directions are diametrically opposed, it is possible to define a link that advances in a direction opposite to the advance direction of the exit link 71, in the same road section as the road section in which the exit link 71 is defined. However, according to the Road Traffic Act, in a case where a turn is prohibited in the node 60, there is little need to consider a possibility that vehicles travel from the link, which advances in the direction opposite to the advance direction of the exit link 71, to the exit link 71 via the node 60. In the above-mentioned case, there is no need to take the link that advances in the direction opposite to the advance direction of the exit link 71 as an advance link. However, in a case where a turn is permitted in the node 60, the link that advances in the direction opposite to the advance direction of the exit link 71 may be taken as an advance link. For convenience of description, FIG. 1 shows the case where the number of entry links entering the node 60 is three, but the number of entry links entering the node 60 is not limited thereto, and the number may be one, two, or four or more.

The method of measuring the traffic volumes of the links 71, 72, 73, 74 is not limited to the method of acquiring the probe data from the vehicles 40, and a known method of measuring the number of the vehicles 40 passing through the links (for example, a method using a camera for detecting the vehicles 40 by image recognition, a laser level sensor for detecting the vehicles 40 using a laser, an ultrasonic sensor for detecting the vehicles 40 using ultrasonic waves, or a loop coil for detecting the vehicles 40 using an electromagnetic field) may be used. Therefore, in the specification, "vehicle" means a vehicle under the Road Traffic Act and is not limited to a probe car. Examples of the vehicle under the Road Traffic Act include automobiles, motorized bicycles, light vehicles, and trolley buses.

The above described embodiment is for facilitating the understanding of the disclosure, and is not intended to be construed as limiting the disclosure. The disclosure can be modified or improved without departing from the spirit of the disclosure, and the disclosure includes equivalents thereof. That is, those in which design modifications are appropriately made to the embodiment by those skilled in the art are also included in the scope of the disclosure as long as they have the features of the disclosure. Each element included in the embodiment can be combined as far as technically possible and the combination of these elements is also within the scope of the disclosure as long as the features of the disclosure are included.

What is claimed is:

1. A traffic volume determination system comprising:

a storage device configured to store a table configured to store information indicating a statistical proportion of vehicles flowing into an exit link exiting from a node, among other vehicles traveling on an entry link entering the node; and a processor configured to calculate an estimated value of a traffic volume of vehicles traveling on the exit link from an actual traffic volume of the other vehicles traveling on the entry link, with reference to the table, and determine that the exit link is closed when an actual traffic volume of the vehicles traveling on the exit link is smaller than the estimated value.

2. The traffic volume determination system according to claim 1, wherein the table is configured to further store information indicating a statistical proportion of vehicles having no history of traveling on the entry link among the vehicles traveling on the exit link.

3. A traffic volume determination system comprising:

a storage device configured to store a table configured to sort out and store information indicating a statistical proportion of vehicles flowing into an exit link exiting from a node, among other vehicles traveling on a plurality of entry links entering the node, for each entry link; and a processor configured to calculate an estimated value of a traffic volume of vehicles traveling on the exit link from an actual traffic volume of the other vehicles traveling on each of the entry links, with reference to the table, and determine that the exit link is closed when an actual traffic volume of the vehicles traveling on the exit link is smaller than the estimated value.

4. The traffic volume determination system according to claim 3, wherein the table is configured to further store information indicating a statistical proportion of vehicles having no history of traveling on the entry link among the vehicles traveling on the exit link.

5. A traffic volume determination method comprising:

preparing a table configured to store information indicating a statistical proportion of vehicles flowing into an exit link exiting from a node, among other vehicles traveling on an entry link entering the node, by a computer system;

calculating an estimated value of a traffic volume of vehicles traveling on the exit link from an actual traffic volume of the other vehicles traveling on the entry link, with reference to the table, by the computer system; and determining that the exit link is closed when an actual traffic volume of the vehicles traveling on the exit link is smaller than the estimated value, by the computer system.

6. A non-transitory computer-readable storage medium storing a traffic volume determination program, the traffic volume determination program causing a computer system to execute steps of:

preparing a table configured to store information indicating a statistical proportion of vehicles flowing into an exit link exiting from a node, among other vehicles traveling on an entry link entering the node;

calculating an estimated value of a traffic volume of vehicles traveling on the exit link from an actual traffic volume of the other vehicles traveling on the entry link, with reference to the table; and determining that the exit link is closed when an actual traffic volume of the vehicles traveling on the exit link is smaller than the estimated value.

* * * * *